US005814751A

United States Patent [19]

Imamura

[11] Patent Number: 5,814,751

[45] Date of Patent: Sep. 29, 1998

[54] MUSICAL TONE GENERATING APPARATUS

[75] Inventor: Miyuki Imamura, Tokyo, Japan

[73] Assignee: Seikosha Co., Ltd., Tokyo, Japan

[21] Appl. No.: 551,385

[22] Filed: Nov. 1, 1995

[30] Foreign Application Priority Data

Nov. 2, 1994 [JP] Japan ..... 6-269575
Nov. 2, 1994 [JP] Japan ..... 6-269576

[51] Int. Cl.[6] ..... G10H 7/00; G10H 7/02

[52] U.S. Cl. ..... 84/604; 84/609; 84/622; 84/626

[58] Field of Search ..... 84/603, 604, 605, 84/606, 607, 609, 610, 622, 623, 624, 625, 626

[56] References Cited

U.S. PATENT DOCUMENTS 3,823,390 7/1974 Tomisawa et al. .
4,224,856 9/1980 Ando et al. .
4,679,480 7/1987 Suzuki ..... 84/604
4,754,679 7/1988 Suzuki ..... 84/1.19

*Primary Examiner*—William M. Shoop, Jr.
*Assistant Examiner*—Marlon T. Fletcher
*Attorney, Agent, or Firm*—Jordan and Hamburg

[57] ABSTRACT

A musical tone generating apparatus is capable of reproducing natural musical tones while waveform memories of a nominal capacity. The apparatus comprises a first waveform memory 1*a* for storing first waveform data of one period of a stationary first waveform existing after an elapse of a certain period from the beginning of generation of a musical tone and a second waveform memory 1*b* for storing second waveform data of one period of a second waveform representing differential spectral components derived from spectral differences between a fundamental wave component and harmonic components of the non-stationary waveform determined immediately after the beginning of generation of the musical tone and a fundamental wave component and harmonic components of the first waveform. A first multiplier generates first multiplication data by multiplying the first waveform data with a first level coefficient which varies as a function of time and a second multiplier generates second multiplication data by multiplying the second waveform data with a second level coefficient which varies as a function of time. A level coefficient generator provides the first level coefficient and the second level coefficient while an adder sums the first multiplication data and the second multiplication data.

9 Claims, 7 Drawing Sheets

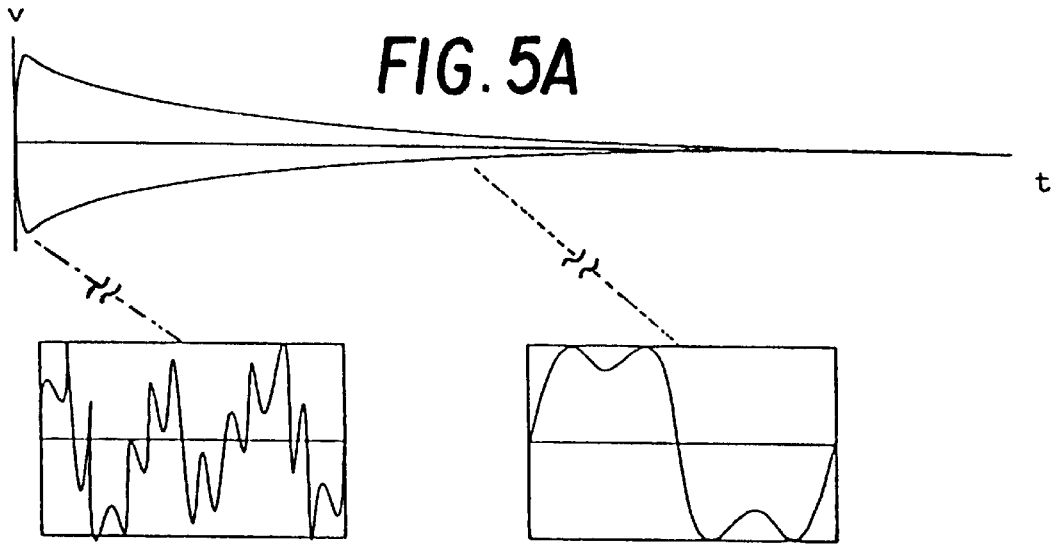
FIG. 5A
FIG. 5C
FIG. 5B
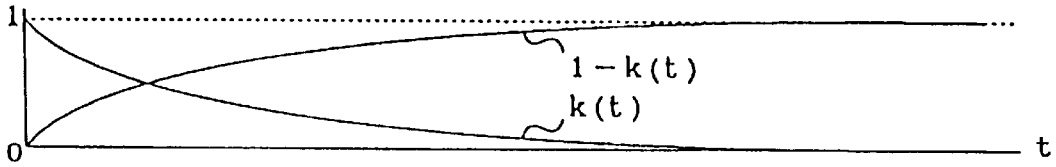
FIG. 5D
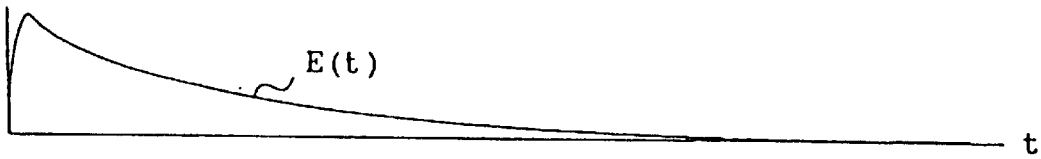
FIG. 5E

FIG.6A
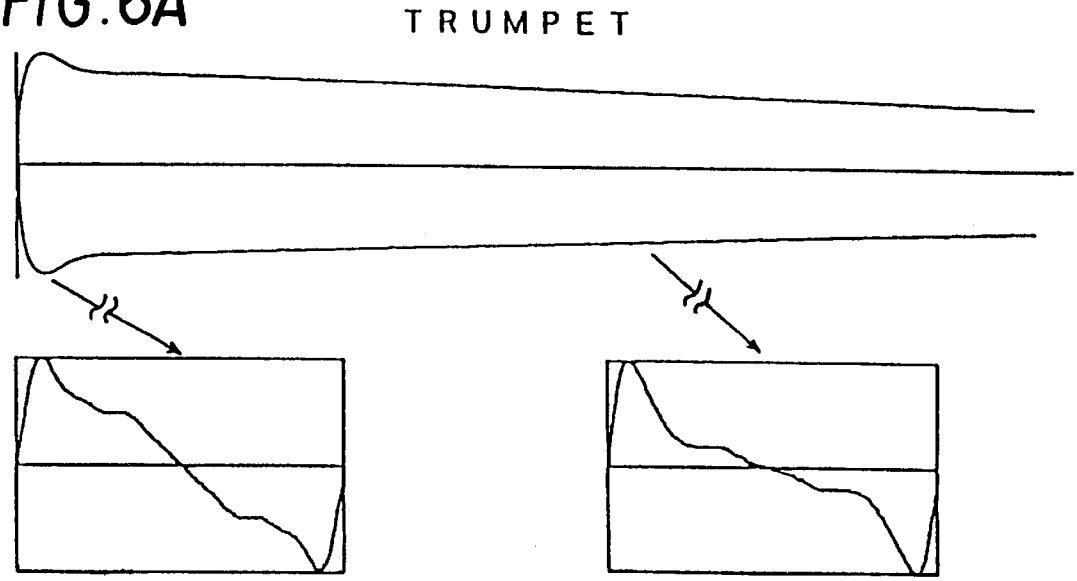
FIG.6C
FIG.6B
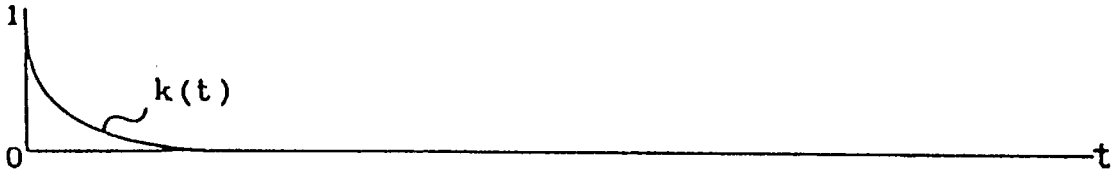
FIG.6D
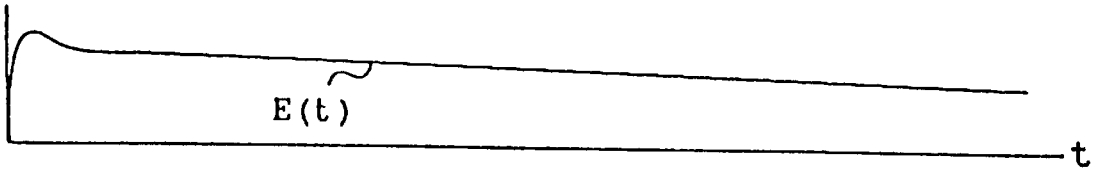
FIG.6E

FIG. 7A
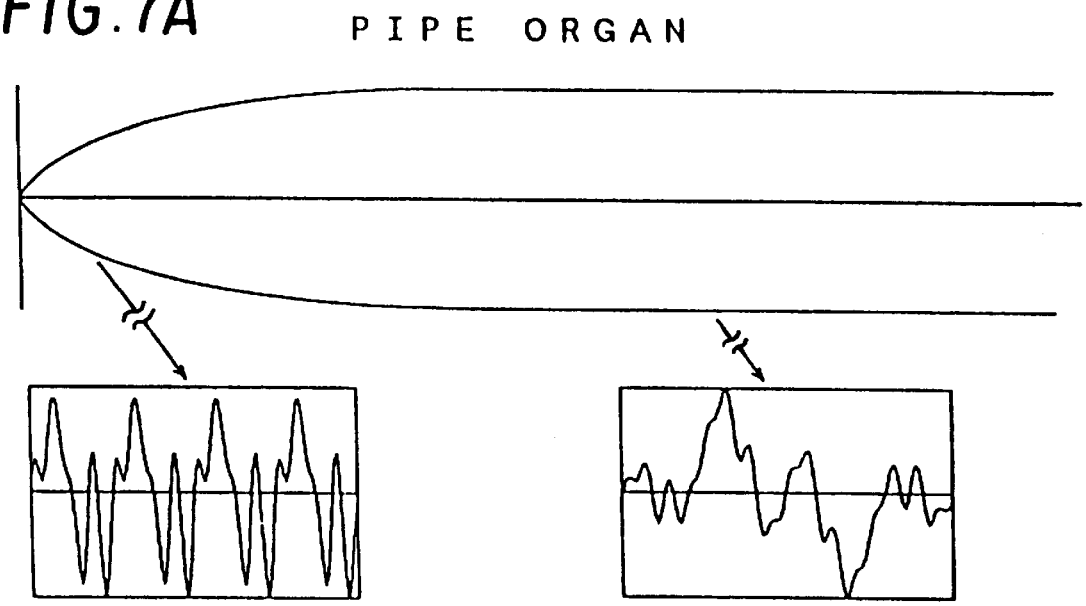
FIG. 7C
FIG. 7B
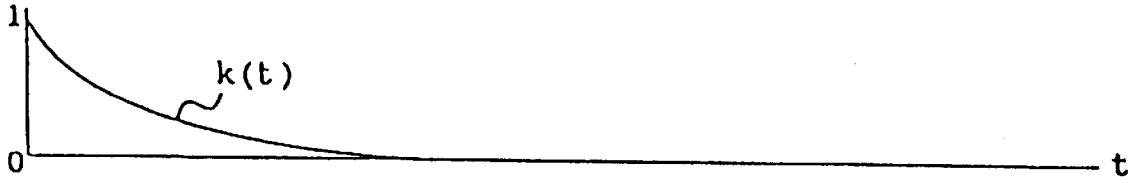
FIG. 7D
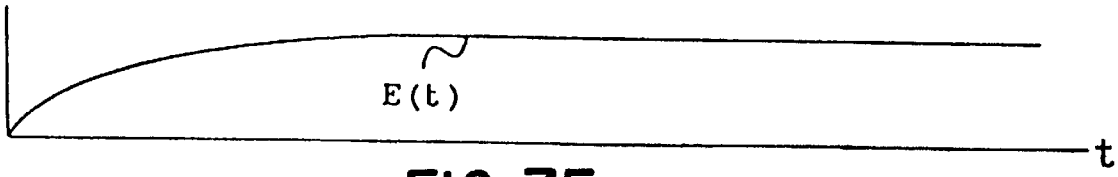
FIG. 7E

MUSICAL TONE GENERATING APPARATUS

BACKGROUND OF THE INVENTION

The present invention relates to a musical tone generating apparatus used for generating musical tones in an electronic musical instrument, electronic music box or similar apparatus.

Hitherto, a large number of electronic musical instruments utilizing digital technologies to reproduce musical tones have been proposed. Conventionally, such instruments generate a waveform amplitude value at each sample point of a musical tone waveform by various means. The amplitude waveform values are generated or read at a rate corresponding to a pitch frequency of the desired tone to be reproduced and applied to a DAC driving an audio transducer.

One of the simplest methods employed is one which stores an amplitude value at each sample point for a whole waveform of a musical tone, from the beginning to the end, in a waveform memory and generates a musical tone waveform by sequentially reading out the amplitude values. Such a method is discussed in Japanese Patent Laid-Open No. 52-121313. The merit of the method is that sound of a natural musical instrument can be reproduced by sampling at an adequate bit rate.

Another known method stores only a fundamental waveform for parts of the whole musical tone waveform where there is little change in timbre. The values of the fundamental waveform are then repeatedly read to reproduce the desired tone. This method reduces a capacity of the waveform memory required by repeatedly reading out the stored values. Such a method is disclosed in Japanese Patent Laid-Open No. 59-30599.

A drawback of the first method is that the required memory capacity for storing the waveform data becomes enormous, presenting a significant obstacle to miniaturizing the apparatus and lowering the cost thereof. The second method has a drawback in that it requires a large memory capacity to reproduce a so-called attack section where the change of the waveform is intense, similarly presenting an obstacle to miniaturizing the apparatus and lowering the cost thereof.

SUMMARY OF THE INVENTION

Accordingly, it is an object of the present invention to provide a musical tone generating apparatus capable of generating natural musical tones using a waveform memory having a relatively small capacity.

Briefly stated, the present invention provides a musical tone generating apparatus capable of reproducing natural musical tones while having waveform memories of a nominal capacity. The apparatus comprises a first waveform memory 1*a* for storing first waveform data of one period of a stationary first waveform existing after an elapse of a certain period from the beginning of generation of a musical tone and a second waveform memory 1*b* for storing second waveform data of one period of a second waveform representing differential spectral components derived from spectral differences between a fundamental wave component and harmonic components of the non-stationary waveform determined immediately after the beginning of generation of the musical tone and a fundamental wave component and harmonic components of the first waveform. A first multiplier generates first multiplication data by multiplying the first waveform data with a first level coefficient which varies as a function of time and a second multiplier generates second multiplication data by multiplying the second waveform data with a second level coefficient which varies as a function of time. A level coefficient generator provides the first level coefficient and the second level coefficient while an adder sums the first multiplication data and the second multiplication data.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 5 is a graph of musical tone waveforms;

FIG. 6 is a graph of other musical tone waveforms; and

FIG. 7 is a graph of still other musical tone waveforms.

DETAILED DESCRIPTION OF THE INVENTION

Figure 2A:
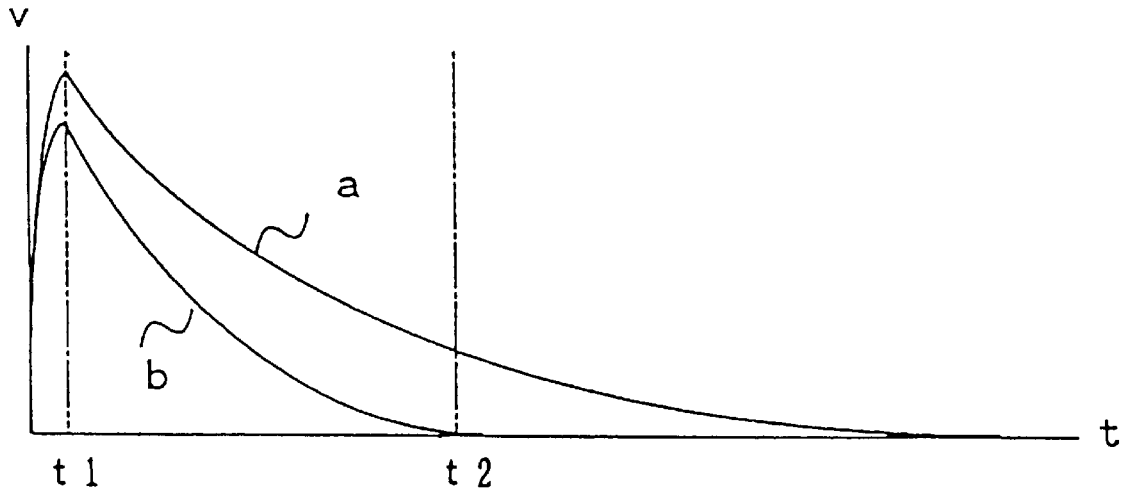
FIG. 2 is a graph of musical tone waveforms.
Figure 2B:
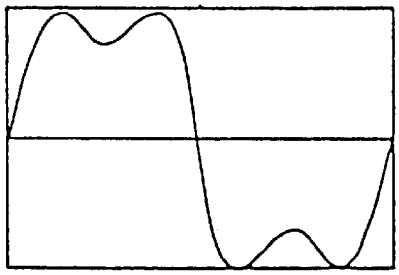
Figure 2C:
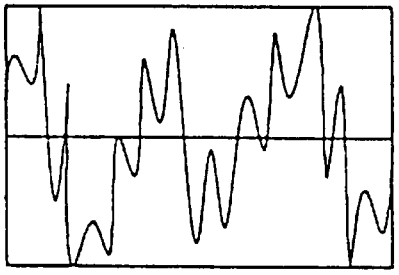

Referring to FIGS. 2A, 2B and 3 the principle of a first embodiment of the present invention is presented as follows. A waveform "a" in FIG. 2A illustrates a level change of a waveform of a musical tone from an audible beginning until an attenuated ending thereof. FIG. 2B shows a waveform of one period of the musical waveform after an elapse of a sufficient time (at time t2) from the beginning of the musical waveform. FIG. 2C shows one period of a waveform starting at a beginning of the musical waveform (at time t1). While an initial portion of the musical waveform of a natural musical instrument having an attenuation, or decaying system characteristic, such as that of a music box, is complicated, containing a number of harmonic components, the harmonic components eventually decay and the waveform transforms to a monotonous waveform having a waveform shape close to that of a sine wave at the desired pitch as time elapses. Further, although a degree of change of the waveform is large immediately after the sounding, the degree of change of the waveform becomes small and the waveform itself becomes stable as time elapses. In other words, the waveform is non-stationary, or changing, immediately after the beginning of the musical tone and becomes stationary, or constant in shape, as a certain period elapses from the beginning of the musical tone.

Figure 3A:
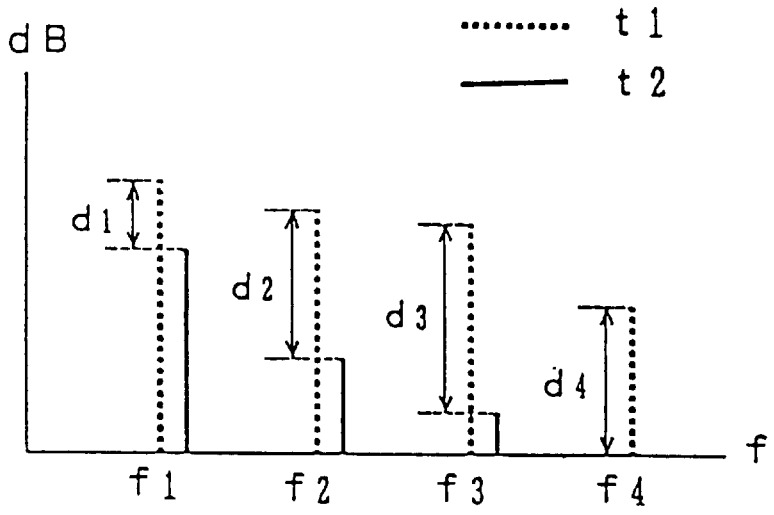
FIG. 3. is a graph of a spectrum related to musical tone waveforms.

Referring to FIG. 3A, an average (stationary) spectrum at time t2 of the waveform of FIG. 2A is shown (illustrated by solid lines; hereinafter called "fundamental spectrum" for convenience) and a characteristic (non-stationary) spectrum at time t1 of the waveform of FIG. 2A is shown ( illustrated by dotted lines; hereinafter called "initial spectrum" for convenience). When the level change characteristic "a" of FIG. 2A is given to the waveform having the above-mentioned fundamental spectrum, differences d1, d2, d3, . . . etc. are produced at t1 with respect to the initial spectrum as shown in FIG. 3A. the difference d1 is a difference in level of the fundamental frequency component, or the fundamental wave f1, and dn is a difference in level of the frequency component at an nth order harmonic fn of the fundamental frequency. A relative difference between the differences d2, d3, . . . in each harmonic and the difference d1 in the fundamental wave is designated Dn, where Dn=dn−d1, and relative differential spectrum shown in FIG. 3B is obtained.

A desired musical tone, produced by a music box, for example, is generated from stored waveform data of one period having the above-mentioned fundamental spectrum and waveform data of one period having the above-mentioned relative differential spectrum. The musical tone is generated by reading the data repeatedly and applying the level change characteristic "a", shown in FIG. 2A, to the former waveform data and the level change characteristic "b", also shown in FIG. 2A, to the latter waveform data, and adding them to each other.

Figure 3B:
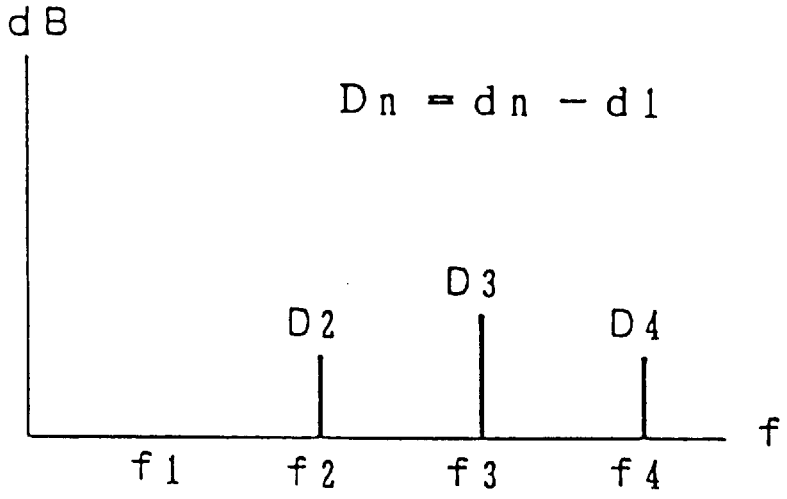

Referring to FIG. 1A, the first embodiment of the present invention has a waveform memory 1*a* into which is stored one period of waveform data having the above-mentioned fundamental spectrum (solid lines in FIG. 3A) and a waveform memory 1*b* into which is stored one period of waveform data having the above-mentioned relative differential spectrum Dn of FIG. 3B. Address counters 2*a* and 2*b* generate addresses for reading the waveform data out of the waveform memories 1*a* and 1*b* at a fixed rate corresponding to the frequency pitch.

A level coefficient generating means 3*a* generates level coefficient data corresponding to level characteristic "a" in FIG. 2A for the waveform data read out of the waveform memory 1*a*. A level coefficient generating means 3*b* generates level coefficient data corresponding to level characteristic "b" in FIG. 2A for the waveform data readout of the waveform memory 1*b*. A multiplier 4*a* multiplies the waveform data from the waveform memory 1*a* with the level coefficient data from the level coefficient generating means 3*a*. A multiplier 4*b* multiplies the waveform data from the waveform memory 1*b* with the level coefficient data from the level coefficient generating means 3*b*. An adder 5 adds the multiplication data produced by the multipliers 4*a* and 4*b*. A D/A converter 6 converts the digital data from the adder 5 into analog data.

Figure 1:
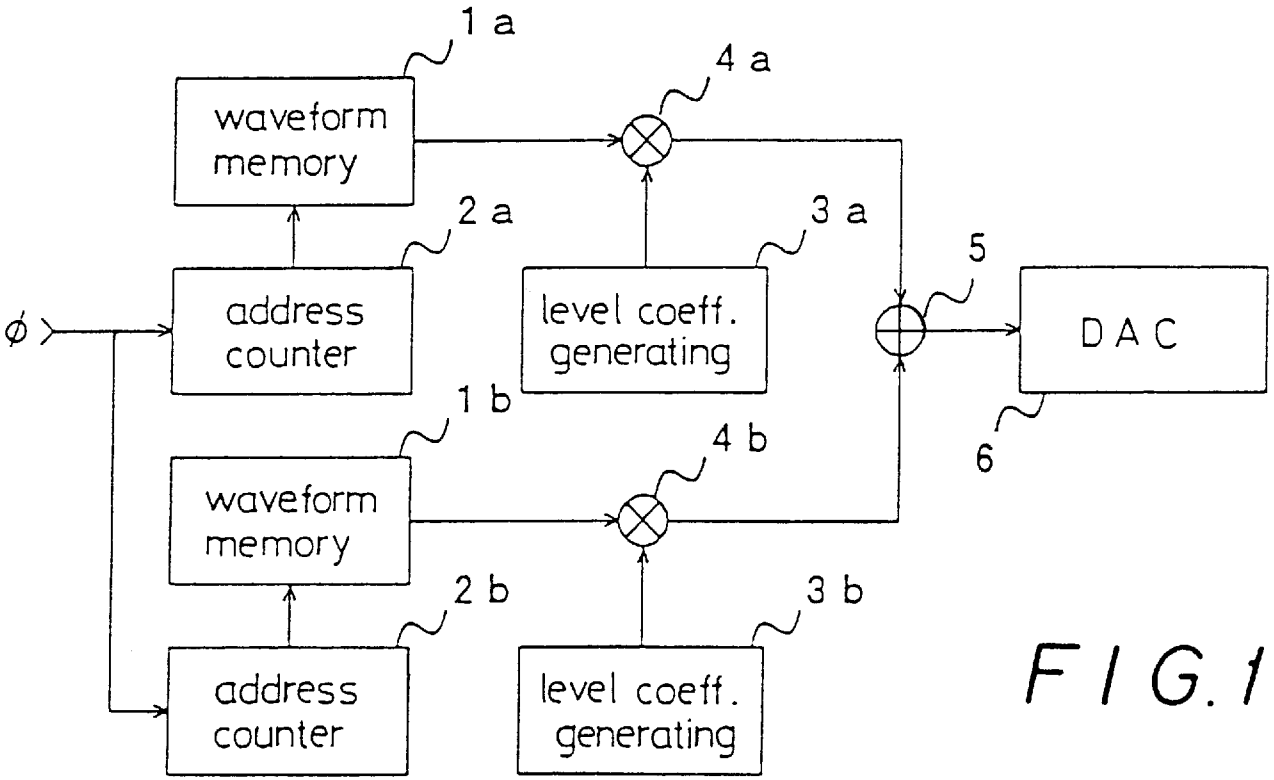
FIG. 1 is a block diagram of a first embodiment of the present invention.

Operation of the first embodiment of FIG. 1 entails storing musical tone data corresponding to desired musical tone needs in the waveform memories 1*a* and 1*b* as well as in the level coefficient generating means 3*a* and 3*b* prior to operating. The storage of the musical tone data requires execution of the following a method for forming the waveform data to be stored in the waveform memories 1*a* and 1*b*. Generally, the waveform data is formed based on the principle of Fourier transformation and inverse Fourier transformation. Initially, spectrum analysis is carried out on a certain section of waveform immediately after the beginning of the musical tone and on a certain section of waveform after an elapse of a predetermined time period from the beginning of the musical tone to find the fundamental wave components and the harmonic components for each portion of the waveform. The fundamental spectrum indicated by the solid lines in FIG. 3A and the initial spectrum indicated by the dotted lines in FIG. 3A are thus determined. Then, the relative differential spectrum shown in FIG. 3B is determined from the fundamental spectrum and the initial spectrum. When the fundamental wave component and each harmonic wave component are represented as Cn (where n is an integer 1 or more than 1) corresponding to the order thereof, the waveform data of one period Dm is represented as follows:

$$D(m) = q \cdot \sum_{n=1}^{N} \{Cn \cdot \mathrm{SIN}(2\pi nm/S - \phi n)\}$$

Where, q is a coefficient for optimizing an amplitude value, n is an order of the fundamental wave and each harmonic, N is the highest order, S is a number of data in the waveform memory, m is an integer from 0 to S−1 and $\phi$ n is a phase of the fundamental wave and nth order harmonic. Waveform data of one period corresponding respectively to the fundamental spectrum and the relative differential spectrum is thus found and is stored in the waveform memories 1*a* and 1*b*. Level coefficient data corresponding to characteristic "a" in FIG. 2A is stored in the level coefficient generating means 3*a* and level coefficient data corresponding to characteristic "b" in FIG. 2A is stored in the level coefficient generating means 3*b*, respectively, prior to musical tone generation.

Generation of a musical tone begins with the waveform data stored in the waveform memories 1*a* and 1*b* being read at the fixed rate corresponding to the pitch frequency f by use of address signals from the address counters 2*a* and 2*b*. The reading rate is defined by a clock signal $\phi$, where $\phi$=f·S, which drives the address counters 2*a* and 2*b*.

The multiplier 4*a* multiplies the waveform data form the waveform memory 1*a* by the level coefficient data (data corresponding to "a" in FIG. 2A) from the level coefficient generating means 3*a* and the multiplier 4*b* multiplies the waveform data from the waveform memory 1*b* by the level coefficient data (data corresponding to "b" in FIG. 2A) from the level coefficient generating means 3*b*. The adder 5 adds the multiplication data obtained by the multipliers 4*a* and 4*b*. The sum data from the adder 5 is then converted from digital to analog by the D/A converter 6. Thus, the desired musical tone output is produced.

Note that although the above explanation has been made assuming the musical tone of the attenuation system such as the music box, it is of course possible to obtain not only the musical tone of the attenuation system but also various musical tones of trumpet, organ or the like.

Further, it is also possible to store multiple types of data respectively in the waveform memories 1*a* and 1*b* and the level coefficient generation means 3*a* and 3*b*. Thereby, multiple types of musical tones are producible such as that of a piano, trumpet and pipe organ. Furthermore, if one type of waveform data is stored in the waveform memories 1*a* and 1*b* (e.g. piano data) and multiple types of data are stored in the level coefficient generating means 3*a* and 3*b*, sounds of pianos having a plurality of different tonal qualities are optionally generated.

Referring to FIGS. 5A–5E, another method of the present invention uses various characteristics of a waveform of a musical tone from the beginning of sounding musical tones of a music box, or similar device, until the waveform attenuates. FIG. 5B shows one period of the waveform after an elapse of sufficient time from the beginning of the musical tone while FIG. 5C shows another single period of the waveform immediately after the beginning of the musical tone. While the initial waveform of the natural musical instrument of an attenuation system, such as a music box, is complicated, containing a number of harmonic components, the harmonic components attenuate and the waveform transforms to a monotonous waveform close in shape to a sine wave as time elapses. Further, although a degree of change of the waveform is large immediately after the sounding of the musical tone, the degree of change of the waveform becomes small and the waveform itself becomes stable as time elapses. That is, the waveform is non-stationary immediately after the beginning of the musical tone and becomes stationary as a certain period elapses since the beginning of generation of the musical tone.

A desired musical tone, of a music box for example, is generated by storing waveform data representing the waveform periods of FIGS. 5B and 5C in advance, and then by reading the waveform data repeatedly, multiplying the waveform data represented in FIG. 5B by data representing the characteristic 1−k(t) in FIG. 5D, multiply the waveform data represented in FIG. 5C by data representing the characteristic k(t) in FIG. 6, and by multiplying a value, obtained by adding the both the above multiplication results, by data representing an envelope E(t) shown in FIG. 5E.

Figure 4:
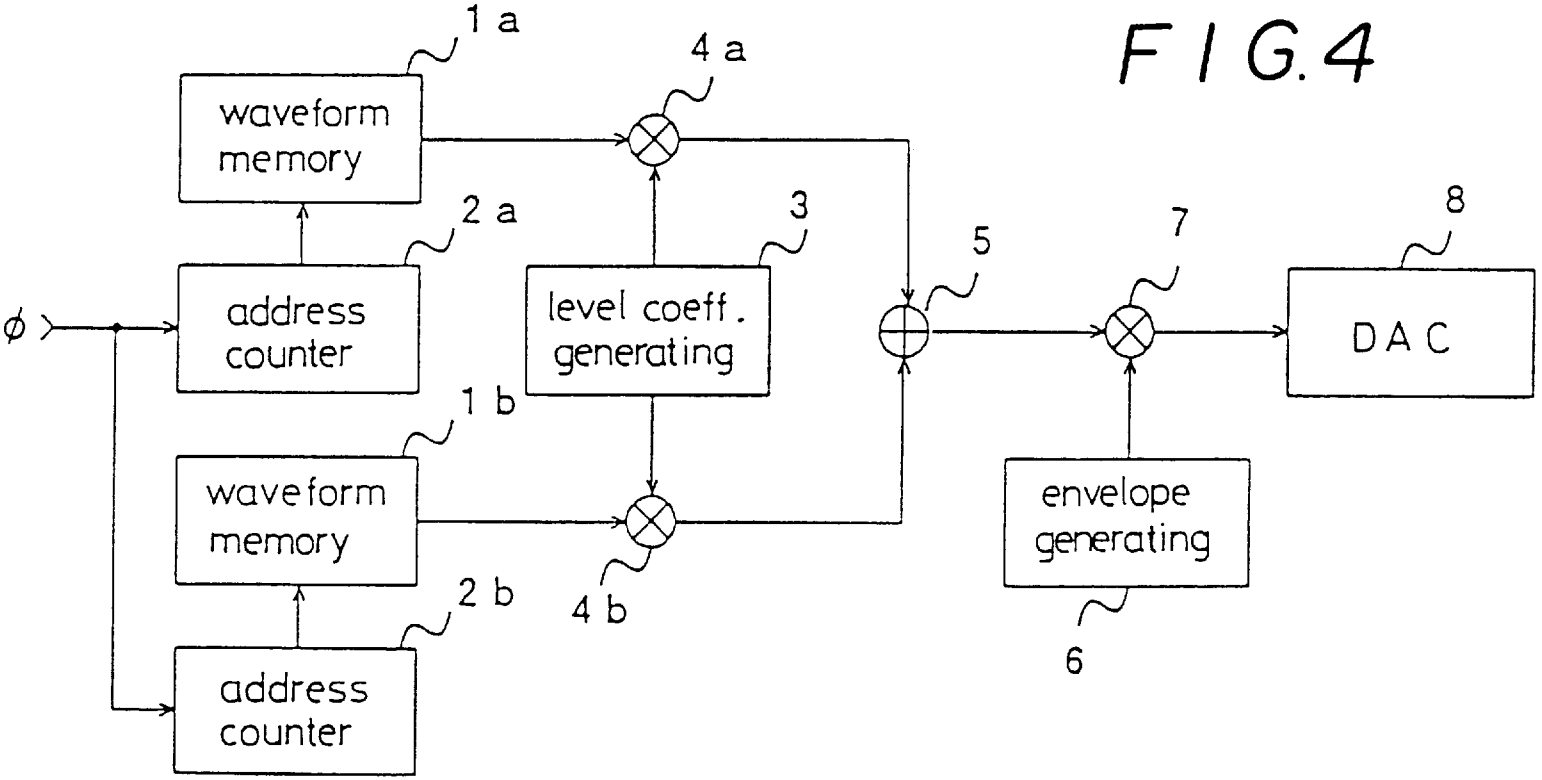
FIG. 4 is a block diagram of a second embodiment of the present invention.

Referring to FIG. 4, another embodiment of the present invention has a waveform memory 1*a* for storing the waveform data in FIG. 5B, data representing one period of the waveform data when the certain time has elapsed since the beginning of the sounding of the musical tone and a waveform memory 1*b* stores the waveform data in FIG. 5C, data representing the other single period of the waveform data immediately after the beginning of the sounding of the musical tone. Address counters 2*a* and 2*b* generate addresses for reading the waveform data out of the waveform memories 1*a* and 1*b* with a fixed rate corresponding to a pitch frequency.

Level coefficient generating means 3 generates level coefficient data (data corresponding to the characteristics 1−k(t) and k(t) in FIG. 5D) for changing a synthesizing ratio of the waveform data read out of the waveform memories 1*a* and 1*b*. A multiplier 4*a* multiplies the waveform data from the waveform memory 1*a* with the level coefficient data (data corresponding to k(t) in FIG. 5D) from the level coefficient generating means 3. An adder 5 adds the multiplication data obtained by the multipliers 4*a* and 4*b*.

Envelope generating means 6 generates the envelope data (data corresponding to E(t) in FIG. 5E) for providing a time-wise change of sound volume to the addition data obtained by the adder 5. A multiplier 7 multiplies the addition data from the adder 5 with the envelope data from the envelope generating means 6. A D/A converter 8 converts the digital data from the multiplier 7 into analog data.

Prior to operation, data corresponding to a desired musical tone is stored in the waveform memories 1*a* and 1*b* as well as in the level coefficient generating means 3. A method for forming the waveform data (data corresponding to FIGS. 5B and 5C) to be stored in the waveform memories 1*a* ad 1*b* generally involves the use of Fourier transformations and inverse Fourier transformations. At first, spectrum analysis is carried out on the period of the waveform occurring immediately after the beginning of the sounding and on the other period of the waveform occurring after an elapse of the sufficient period since the beginning of the sounding of the musical tone to find fundamental wave components and harmonic components thereof for each. When the fundamental wave component and each of the harmonic components are represented as Cn (where n is an integer 1 or more than 1) corresponding to the order thereof, the waveform data of one period Dm is represented as follows:

$$D(m) = q \cdot \sum_{n=1}^{N} \{Cn \cdot \mathrm{SIN}(2\pi nm/S - \phi n)\}$$

where, q is a coefficient for optimizing an amplitude value, n is an order of the fundamental wave and each harmonic, N is the highest order, S is a number of data in the waveform memory, m is an integer from 0 to S−1 and $\phi$ n is a phase of the fundamental wave and nth order harmonic. Waveform data of one period corresponding respectively to FIGS. 5B and 5C is thus found and stored in the waveform memories 1*a* and 1*b* in advance. Level coefficient data (data corresponding to 1−k(t) and k(t) in FIG. 5D) is stored in the level coefficient generating means 3 in advance.

The waveform data stored in the waveform memories 1*a* and 1*b* is read at the fixed rate corresponding to the pitch frequency f based on address signals from the address counters 2*a* and 2*b*. The reading rate is defined by a clock signal $\phi$, where $\phi$=f·S, which is input to the address counters 2*a* and 2*b*.

The multiplier 4*a* multiplies the waveform data from the waveform memory 1*a* by the level coefficient data (data corresponding to 1−k(t) in FIG. 5D) from the level coefficient generating means 3 and the multiplier 4*b* multiplies the waveform data from the waveform memory 1*b* by the level coefficient data (data corresponding to k(t) in FIG. 5D) from the level coefficient generating means 3. The adder 5 adds the multiplication data obtained by the multipliers 4*a* and 4*b*. When the waveform data read out of the waveform memories 1*a* and 1*b* are da ($\phi$, t) and db($\phi$,t), the addition data d output from the adder 5 is represented as follows:

$$d = da(\phi, t) \cdot \{1 - k(t)\} + db(\phi, t) \cdot k(t)$$

where, k(t) is in the range 0 <k(t)<1.

The multiplier 7 multiplies the addition data d from the adder 5 with the envelope data (data corresponding to E(t) in FIG. 5E) from the envelope generating means 6. The multiplication data d' output from the multiplier 7 is represented as follows:

$$d' = [da(\phi, t) \cdot \{1 - k(t)\} + db(\phi, t) \cdot k(t) \cdot E(t)$$

The multiplication data d' is converted from digital to analog by the D/A converter 8.

The desired musical tone output is obtained by the above method and apparatus. Note that although the above explanation has been made assuming mainly the musical tone of the attenuation system such as the music box, it is of course possible to obtain not only the musical tone of the attenuation system but also various musical tones such as those of a trumpet, an organ or other instruments. FIGS. 6A through 6E show waveforms of a trumpet and FIGS. 7A through 7E show waveforms of a pipe organ in correspondence with FIGS. 5A and 5E, respectively.

Further, it is also possible to store multiple types of data respectively in the waveform memories 1*a* and 1*b* and in the level coefficient generating means 3. For example, if the waveform data corresponding respectively to FIG. 5B, FIG. 6B and FIG. 7B is stored in the waveform memory 1*a*, the waveform data corresponding respectively to FIG. 5C, FIG. 6C and FIG. 7C is stored in the waveform memory 1*b*, and the data corresponding respectively to FIG. 5D, FIG. 6D and FIG. 7D is stored in the level coefficient generating means 3 and the corresponding envelope is generated from the envelope generating means 6, three types of musical tones are optionally generated. Furthermore, if one type of waveform data is stored in the waveform memories 1*a* and 1*b* (e.g. "piano" data) and multiple types of data is stored in the level coefficient generating means 3, a sound of piano having a plurality of different tones, for example, are optionally generated.

According to the present invention, it is possible to generate natural musical tones using waveform memories having a small capacity relative to those of other prior systems. As a result, the simple structure of the present invention can effectively simulate tones of a natural musical instrument.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A musical tone generating apparatus for generating a musical tone comprising:

a first waveform memory for storing first waveform data representing a first waveform portion of a stationary first waveform of said musical tone consisting essentially of one period existing at an elapse of a first predetermined time period following a beginning of said musical tone at which time initial transient harmonics associated with the beginning of the musical tone have substantially decayed;

a second waveform memory for storing second waveform data representing a second waveform portion of a second waveform of said musical tone consisting essentially of one period which is derived from differential spectral components representing differences between:

a fundamental wave component and harmonic components of a period of a non-stationary waveform existing at an elapse of a second predetermined time period, shorter than said first predetermined time period, occurring near the beginning of the musical tone about when said initial transient harmonics are at a maximum level: and a fundamental wave component and harmonic components of the first waveform; and synthesizing means for synthesizing output waveform data by repeatedly sequentially reading said first waveform data from said first waveform memory and said second waveform data from said second waveform memory while varying a level of each independently.

2. The musical tone generating means according to claim 1, wherein said synthesizing means includes:

first multiplying means for generating first multiplication data by multiplying said first waveform data with first level coefficients which vary with time;

second multiplying means for generating second multiplication data by multiplying said second waveform data with second level coefficients which vary with time;

level coefficient generating means for generating said first level coefficients and said second level coefficients; and adding means for adding said first multiplication data generated by said first multiplying means and said second multiplication data generated by said second multiplying means.

3. The musical tone generating apparatus according to claim 2, wherein said first level coefficients provide a level change corresponding to a change of amplitude of the musical tone generated by said musical tone generating apparatus and said second level coefficients provide a level change corresponding to a change of harmonic components of the musical tone generated by said musical tone generating apparatus.

4. A musical tone generating apparatus for generating a desired musical tone, comprising:

a first waveform memory for storing first waveform data representative of a first portion of said desired musical tone consisting of one period, said first portion of said desired musical tone representing a stationary waveform existing at an elapse of a predetermined time period from the beginning of said musical tone;

a second waveform memory for storing second waveform data representative of a second portion of said musical tone consisting of one period of said desired musical tone said second portion of said desired musical tone representing a waveform consisting of differences in spectral components of said first portion of said desired musical tone and spectral components of a non-stationary waveform existing immediately after the beginning of said desired musical tone;

synthesizing means for generating synthesized data by repeatedly sequentially reading said first waveform data from said first waveform memory and said second waveform data from said second waveform memory while changing a synthesizing ratio of the first and second waveform data as a function of time; and envelope producing means for providing an envelope defining a level said synthesized data.

5. The musical tone generating apparatus according to claim 4, wherein said synthesizing means comprises:

first multiplying means for generating first multiplication data by multiplying said first waveform data with first level coefficients which vary as a function of time;

second multiplying means for generating second multiplication data by multiplying said second waveform data with second level coefficients which vary as a function of time;

level coefficient generating means for generating said first level coefficients and said second level coefficients; and adding means for adding said first multiplication data generated by said first multiplying circuit and said second multiplication data generated by said second multiplying circuit.

6. The musical tone generating apparatus according to claim 4, wherein said envelope producing means comprises:

envelope data generating means for generating envelope data; and third multiplying means for multiplying said synthesized data synthesized by said synthesizing means with said envelope data.

7. A musical tone generating apparatus for generating a desired musical tone, comprising:

a first waveform memory for storing first waveform data representing one period of a basic waveform existing at a moment at an end of a first predetermined duration after a beginning of said desired musical tone, said basic waveform composed of a first set of spectral components including a fundamental frequency spectral component and harmonic frequency spectral components existing at the moment at the end of said predetermined duration after the beginning of the desired musical tone;

a second waveform memory for storing one period of second waveform data representing, said second waveform data including data representing a waveform composed of frequency components at frequencies corresponding to those of said first set of spectral components at levels given by $$Dn=dn-d1 \ (n=2,3, \ldots)$$

wherein d1 represents a level difference between said fundamental frequency spectral component of said first set of spectral components and a level of said fundamental frequency spectral component existing at the beginning of the desired musical tone and d2 through dn represent level differences between levels of each of 2nd to n-th harmonics of said harmonic frequency spectral components of said first set of spectral components and respective levels of each of said 2nd to n-th harmonics of said harmonic frequency spectral components existing at the beginning of the desired musical tone;

where Dn represents respective levels of said differences between frequency spectral components at said beginning of the desired musical tone and said frequency spectral components of said basic waveform existing at said moment at the end of the predetermined duration after the beginning of the desired musical tone and n corresponds to an applicable harmonic of said frequency spectral components; and synthesizing means for synthesizing output waveform data by repeatedly sequentially reading said first waveform data from said first waveform memory and said second waveform data from said second waveform memory while varying a level of each independently.

8. The musical tone generating apparatus according to claim 7 wherein said synthesizing means includes:

first multiplying means for generating first multiplication data by multiplying said first waveform data with first level coefficients which vary with time;

second multiplying means for generating second multiplication data by multiplying said second waveform data with second level coefficients which vary with time;

level coefficient generating means for generating said first level coefficients and said second level coefficients; and adding means for adding said first multiplication data generated by said first multiplying means and said second multiplication data generated by said second multiplying means.

9. The musical tone generating apparatus according to claim 8 wherein said first level coefficients provide a level change corresponding to a change of amplitude of said desired musical tone to be generated by said musical tone generating apparatus and said second level coefficients provide a level change corresponding to a change of harmonic components of the musical tone to be generated by said musical tone generating apparatus.

* * * * *